US010604893B2

(12) United States Patent
Kajanto et al.

(10) Patent No.: US 10,604,893 B2
(45) Date of Patent: Mar. 31, 2020

(54) METHOD FOR PRODUCING FIBRILLATED CELLULOSE

(71) Applicant: UPM-KYMMENE CORPORATION, Helsinki (FI)

(72) Inventors: Isko Kajanto, Espoo (FI); Markus Nuopponen, Helsinki (FI); Jaakko Pere, Vantaa (FI); Teija Jokila, Espoo (FI)

(73) Assignee: UPM-KYMMENE CORPORATION, Helsinki (FI)

( * ) Notice: Subject to any disclaimer, the term of this patent is extended or adjusted under 35 U.S.C. 154(b) by 353 days.

(21) Appl. No.: 15/129,122

(22) PCT Filed: Mar. 5, 2015

(86) PCT No.: PCT/FI2015/050138
§ 371 (c)(1),
(2) Date: Sep. 26, 2016

(87) PCT Pub. No.: WO2015/150620
PCT Pub. Date: Oct. 8, 2015

(65) Prior Publication Data

US 2017/0107666 A1 Apr. 20, 2017

(30) Foreign Application Priority Data

Mar. 31, 2014 (FI) ..... 20145299

(51) Int. Cl.
*D21C 5/00* (2006.01)
*D21H 11/18* (2006.01)
*D21D 1/20* (2006.01)
*D21C 9/00* (2006.01)

(52) U.S. Cl.
CPC ..... *D21C 5/005* (2013.01); *D21C 9/007* (2013.01); *D21D 1/20* (2013.01); *D21H 11/18* (2013.01)

(58) Field of Classification Search
CPC ..... D21H 11/18; D21H 11/20; D21H 17/005; D21C 5/005; D21C 9/007; D21C 9/00; D21D 1/20; B82Y 40/00
See application file for complete search history.

(56) References Cited

U.S. PATENT DOCUMENTS 4,374,702 A * 2/1983 Turbak ..... D01D 5/11 162/100
4,483,743 A * 11/1984 Turbak ..... D01D 5/11 162/100
5,964,983 A * 10/1999 Dinand ..... C09K 8/206 162/187
6,202,946 B1 3/2001 Virtanen
10,167,576 B2 * 1/2019 Chao ..... D04H 1/425
2012/0135506 A1 * 5/2012 Heiskanen ..... D21C 5/005 435/277
2012/0136146 A1 * 5/2012 Heiskanen ..... D21C 9/007 536/56
2012/0316330 A1 * 12/2012 Zhu ..... B82Y 40/00 536/56
2014/0079931 A1 * 3/2014 Berglund ..... B82Y 30/00 428/219
2014/0124150 A1 * 5/2014 Sabourin ..... D21C 9/001 162/9
2015/0167243 A1 * 6/2015 Bilodeau ..... D21C 5/005 162/65
2015/0259719 A1 * 9/2015 Min ..... C12P 19/14 435/99
2016/0201102 A1 * 7/2016 Zhu ..... C12P 19/02 435/68.1
2016/0355857 A1 * 12/2016 Hiltunen ..... C12P 19/14
2017/0107666 A1 * 4/2017 Kajanto ..... D21D 1/20
2017/0167079 A1 * 6/2017 Hepworth ..... C08B 15/02
2017/0349671 A1 * 12/2017 Kajanto ..... C08B 15/04
2018/0024121 A1 * 1/2018 Yliperttula ..... G01N 33/5008 506/10
2018/0094081 A1 * 4/2018 Nuopponen ..... A61K 31/717
2018/0142084 A1 * 5/2018 Cathala ..... B82Y 40/00
2018/0179703 A1 * 6/2018 Kajanto ..... D21C 9/02

FOREIGN PATENT DOCUMENTS

CA 3002729 A1 * 7/2017 ..... C08J 5/18
CN 1665984 A 9/2005
CN 102472015 A 5/2012
CN 103103847 A 5/2013
CN 103608359 A 2/2014
EP 2226414 A1 9/2010
WO 2004055268 A1 7/2004
WO 2007091942 A1 8/2007
WO 2011004284 A1 1/2011
(Continued)

OTHER PUBLICATIONS

Skals et al., in "Environmental Assessment of Enzyme Assisted Processing in Pulp and Paper Industry," International Journal LCA vol. 13 (2), pp. 124-132. (Year: 2008).*
International Search Report dated May 28, 2015; International Application No. PCT/FI2015/050138; International Filing Date Mar. 5, 2015 (3 pages).
Written Opinion dated May 28, 2015; International Application No. PCT/FI2015/050138; International Filing Date Mar. 5, 2015 (5 pages).
(Continued)

*Primary Examiner* — Jose A Fortuna
(74) *Attorney, Agent, or Firm* — Cantor Colburn LLP

(57) ABSTRACT

The present invention provides a method for producing fibrillated cellulose, the method comprising providing pulp, treating said pulp at a consistency of at least 10% with a cellulase, and fibrillating said pretreated pulp to obtain fibrillated cellulose. The present invention also provides a nanofibrillar cellulose product.

27 Claims, 2 Drawing Sheets

(56) References Cited

FOREIGN PATENT DOCUMENTS

| | | | | | |
|---|---|---|---|---|---|
| WO | WO-2011004284 | A1 * | 1/2011 | ..... | D21C 9/007 |
| WO | WO-2011004300 | A1 * | 1/2011 | ..... | D21C 9/007 |
| WO | WO-2011004301 | A1 * | 1/2011 | ..... | D21C 5/005 |
| WO | 2011056130 | A1 | 5/2011 | | |
| WO | 2012168562 | A1 | 12/2012 | | |
| WO | WO-2012172170 | A1 * | 12/2012 | ..... | D21C 9/005 |
| WO | 2013072559 | A1 | 5/2013 | | |
| WO | WO-2013176033 | A1 * | 11/2013 | | |
| WO | 2014019589 | A1 | 2/2014 | | |
| WO | WO-2014070452 | A1 * | 5/2014 | ..... | D21C 9/001 |
| WO | WO-2014106684 | A1 * | 7/2014 | ..... | C08B 15/08 |
| WO | 2015092146 | A1 | 6/2015 | | |
| WO | WO-2015092146 | A1 * | 6/2015 | ..... | C12P 19/14 |
| WO | WO-2015150620 | A1 * | 10/2015 | ..... | D21D 1/20 |

OTHER PUBLICATIONS

Siqueira, G. et al. "Morphological Investigation of Nanoparticles Obtained From Combined Mechanical Shearing Enzymatic and Acid Hydrolysis of Sisal Fibers", Cellulose, Dec. 2010, vol. 17, pp. 1147-1158.

Jeoh, Tina et al., "Assessing cellulose microfibrillar structure changes due to cellulase action", Carbohydrate Polymers, 2013, vol. 97, p. 581-586.

* cited by examiner

METHOD FOR PRODUCING FIBRILLATED CELLULOSE

CROSS-REFERENCE TO RELATED APPLICATIONS

This application is a National Stage application of PCT/FI2015/050138, filed Mar. 5, 2015, which claims priority to Finnish Application No. 20145299, filed Mar. 31, 2014, both of which are incorporated by reference herein in their entirety.

FIELD OF THE APPLICATION

The present application relates to a method for producing fibrillated cellulose, more particularly by using an enzymatic pretreatment before fibrillating the material.

BACKGROUND

In the refining of lignocellulose-containing fibers by, for example, a disc refiner or a conical refiner at a low consistency of about 3 to 4%, the structure of the fiber wall is loosened, and fibrils or so-called fines are detached from the surface of the fiber. The formed fines and flexible fibers have an advantageous effect on the properties of most paper grades. In the refining of pulp fibers, however, the aim is to retain the length and strength of the fibers. In post-refining of mechanical pulp, the aim is partial fibrillation of the fibers by making the thick fiber wall thinner by refining, for detaching fibrils from the surface of the fiber.

Lignocellulose-containing fibers may also be disintegrated into smaller parts by detaching fibrils which act as components in the fiber walls, wherein the particles obtained become significantly smaller in size. The properties of so-called nanofibrillar cellulose thus obtained differ significantly from the properties of normal pulp. It is also possible to use nanofibrillar cellulose as an additive in papermaking and to increase the internal bond strength (interlaminar strength) and tensile strength of the paper product, as well as to increase the tightness of the paper. Nanofibrillar cellulose also differs from pulp in its appearance, because it is gel-like material in which the fibrils are present in water dispersion. Because of the properties of nanofibrillar cellulose, it has become a desired raw material, and products containing it would have several uses in industry, for example as an additive in various compositions.

Nanofibrillar cellulose can be isolated as such directly from the fermentation process of some bacteria (including *Acetobacter xylinus*). However, in view of large-scale production of nanofibrillar cellulose, the most promising potential raw material is raw material derived from plants and containing cellulose fibers, particularly wood and fibrous pulp made from it. The production of nanofibrillar cellulose from pulp requires the decomposition of the fibers further to the scale of fibrils.

The production of nanofibrillar cellulose from cellulose fibers of the conventional size class has been implemented by disc refiners of laboratory scale, which have been developed for the needs of food industry. This technique requires several refining runs in succession, for example 2 to 5 runs, to obtain the size class of nanocellulose. The method is also poorly scalable up to industrial scale.

Fibrous raw material may be disintegrated to the level of nanofibrillar cellulose by homogenization. In this process, a cellulose fiber suspension is passed several times through a homogenization step that generates high shear forces on the material.

In practice, compromises have to be made in the homogenization upon producing nanofibrillar cellulose: for good fibrillation, high input power/pulp flow rate is needed, which, in turn, decreases the productivity with the available homogenizer power and requires excessive shearing energy. It is, for example, known to pass pulp several times through a homogenizer, to achieve a desired degree of fibrillation. Another problem with the processing of fiber-containing pulp is the susceptibility of homogenizers to clogging due to their structure, which may occur already at relatively low consistencies (1-2%). Untreated native cellulose may damage the valves and other mechanical parts of the homogenizer device.

SUMMARY

One embodiment provides a method for producing fibrillated cellulose, the method comprising providing pulp, treating said pulp at a consistency of at least 10% with a cellulase in mixing, wherein at least 70% of the cellulase activity is exocellulase activity, and after the enzymatic treatment fibrillating said treated pulp to obtain fibrillated cellulose.

On embodiment provides fibrillated cellulose obtained with said method.

The aspects of the invention are characterized in the independent claims. Various embodiments are disclosed in the dependent claims.

By enzymatic pre-treatment of pulp, opening/unravel of fiber cell wall occurs and fibrillation can be performed with high throughput machinery (for example Atrex rotor-rotor dispergator), which is not possible without such pre-treatment. The enzymatic treatment in solution is performed in conditions enabling fiber-fiber contacts, such as consistency of at least 10%. This feature provides such an effect that no prerefining step or chemical pretreatment is required.

The enzyme treatment and the subsequent disintegration into fibrils may be carried out at high consistency, providing an effect that less water is required in the process. There is no need to dilute the product during the process and no extra process steps are required, thus saving time and costs. The obtained product is more concentrated, which lowers for example storage and transportation costs. Further, useful products, such as powder, granules or paste may be obtained. Such products provide advantages in storage, transport and usage, for example granules may be easily fed to a target of usage.

The enzymatic pretreatment provides a pulp product which can be fibrillated using a homogenizer without blocking the homogenization valves or other parts of the device. The obtained nanofibrillated cellulose has a well-controlled diameter in the nanometer range and it maintains high aspect ratio. Also strong aqueous gels with highly tunable storage modulus are obtained.

The method enables production of native cellulose in large quantities using high throughput equipment, which is not possible with other known pre-treatment technology. This feature provides an effect of saving time and money. For the producer the competitive advantage is due to lower production costs of fibrillated cellulose.

The method enables production of native fibrillated cellulose, which is compatible with further chemical additives, such as surfactants and the like. There are several application areas for native materials, especially when chemically modified cellulose is not suitable, such as rheology modifier, stabilizer, sealing agent, strengthening component or other additive for paper and board, paints, oilfields, food, cosmetics, medical products, reinforcement in composite materials, barrier for packages, carrier of bioactive components etc.

DETAILED DESCRIPTION OF THE EMBODIMENTS

Figure 1:
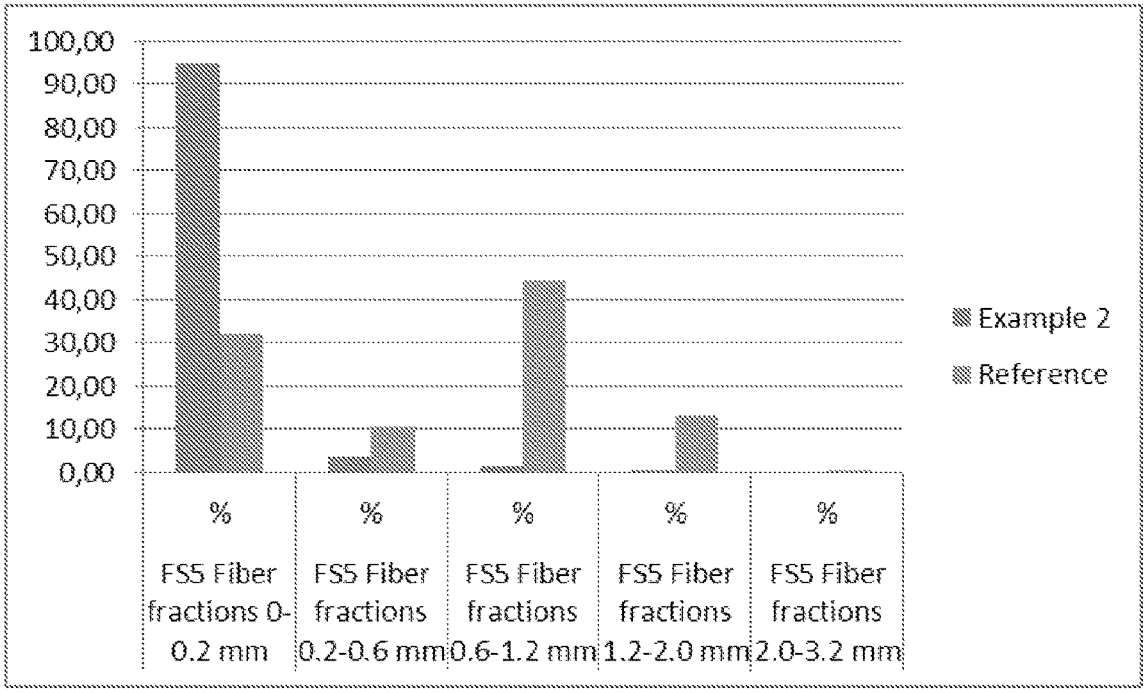
FIG. 1 shows a graph illustrating the fiber size measured by Metso FS5 fiber analyzer.

In the following disclosure, all percent values are by weight, if not indicated otherwise. Further, all numerical ranges given include the upper and lower values of the ranges, if not indicated otherwise.

In the present application all results shown and calculations made, whenever they are related to the amount of pulp, are made on the basis of dried pulp.

In this application, nanofibrillar cellulose refers to cellulose microfibrils or microfibril bundles separated from cellulose-based fiber raw material. These fibrils are characterized by a high aspect ratio (length/diameter): their length may exceed 1 μm, whereas the diameter typically remains smaller than 200 nm. The smallest fibrils are in the scale of so-called elementary fibrils, the diameter being typically in the range of 2-12 nm. The dimensions and size distribution of the fibrils depend on the refining method and efficiency. Nanofibrillar cellulose may be characterized as a cellulose-based material, in which the median length of particles (fibrils or fibril bundles) is not greater than 50 μm, for example in the range of 1-50 μm, and the particle diameter is smaller than 1 μm, suitably in the range of 2-500 nm. In case of native fibril cellulose, in one embodiment the average diameter of a fibril is in the range of 5-100 nm, for example in the range of 10-50 nm. Nanofibrillar cellulose is characterized by a large specific surface area and a strong ability to form hydrogen bonds. In water dispersion, the nanofibrillar cellulose described herein typically appears as either light or turbid gel-like material. Depending on the fiber raw material, nanofibrillar cellulose may also contain small amounts of other wood components, such as hemicellulose or lignin. The amount is dependent on the plant source. Often used parallel names for nanofibrillar cellulose include nanofibrillated cellulose (NFC), which is often simply called nanocellulose, and microfibrillated cellulose (MFC). "Fibrillated cellulose" as used herein refers to nanofibrillated cellulose.

Different grades of nanofibrillated cellulose may be categorized based on three main properties: (i) size distribution, length and diameter (ii) chemical composition, and (iii) rheological properties. Any of these methods alone is not suitable to describe a grade, i.e. the methods should be used in parallel. Examples of different grades include native (or non-modified) NFC, oxidized NFC (high viscosity), oxidized NFC (low viscosity), carboxymethylated NFC and cationized NFC. Within these main grades, also sub-grades exist, for example: extremely well fibrillated vs. moderately fibrillated, high degree of substitution vs. low, low viscosity vs. high viscosity etc. The fibrillation technique and the chemical pre-modification have an influence on the fibril size distribution. Typically, non-ionic grades have wider fibril diameter (for example in the range of 10-50 nm) while the chemically modified grades are a lot thinner (for example in the range of 5-20 nm). Distribution is also narrower for the modified grades. Certain modifications, especially TEMPO-oxidation, yield shorter fibrils.

Depending on the raw material source, e.g. hardwood (HW) vs. softwood (SW) pulp, different polysaccharide composition exists in the final fibril cellulose product. Commonly, the non-ionic grades are prepared from bleached birch pulp, which yields high xylene content (25% by weight). Modified grades are prepared either from HW or SW pulps. In those modified grades, the hemicelluloses are also modified together with the cellulose domain. Most probably, the modification is not homogeneous, i.e. some parts are more modified than others. Thus, detailed chemical analysis is not possible—the modified products are always complicated mixtures of different polysaccharide structures.

In an aqueous environment, a dispersion of cellulose nanofibers forms a viscoelastic hydrogel network. The gel is formed at relatively low concentrations of for example 0.1-0.2% by dispersed and hydrated entangled fibrils. The viscoelasticity of the NFC hydrogel may be characterized for example with dynamic oscillatory rheological measurements.

As regards rheology, the nanofibrillar cellulose hydrogels are shear-thinning materials, which means that their viscosity depends on the speed (or force) by which the material is deformed. When measuring the viscosity in a rotational rheometer, the shear-thinning behaviour is seen as a decrease in viscosity with increasing shear rate. The hydrogels show plastic behaviour, which means that a certain shear stress (force) is required before the material starts to flow readily. This critical shear stress is often called the yield stress. The yield stress can be determined from a steady state flow curve measured with a stress controlled rheometer. When the viscosity is plotted as function of applied shear stress, a dramatic decrease in viscosity is seen after exceeding the critical shear stress. The zero shear viscosity and the yield stress are the most important rheological parameters to describe the suspending power of the materials. These two parameters separate the different grades quite clearly and thus enable classification of the grades.

The dimensions of the fibrils or fibril bundles are dependent on the raw material and the disintegration method. Mechanical disintegration of the cellulose raw material may be carried out with any suitable equipment such as a refiner, grinder, homogenizer, colloider, friction grinder, pin mill, ultrasound sonicator, fluidizer such as microfluidizer, macrofluidizer or fluidizer-type homogenizer. The disintegration treatment is performed at conditions wherein water is sufficiently present to prevent the formation of bonds between the fibers.

In this application, the term "fibrillation" generally refers to disintegrating fiber material mechanically by work applied to the particles, where cellulose fibrils are detached from the fibers or fiber fragments. The work may be based on various effects, like grinding, crushing or shearing, or a combination of these, or another corresponding action that reduces the particle size. The energy taken by the refining work is normally expressed in terms of energy per processed raw material quantity, in units of e.g. kWh/kg, MWh/ton, or units proportional to these. The expressions "disintegration" or "disintegration treatment" may be used interchangeably with "fibrillation".

The fiber material dispersion that is subjected to fibrillation is a mixture of fiber material and water, also herein called as "pulp". The fiber material dispersion may refer generally to whole fibers, parts (fragments) separated from them, fibril bundles, or fibrils mixed with water, and typically the aqueous fiber material dispersion is a mixture of such elements, in which the ratios between the components are dependent on the degree of processing or on the treatment stage, for example number of runs or "passes" through the treatment of the same batch of fiber material.

The fiber material that is used as the starting material may be based on any plant material that contains cellulose. The plant material may be wood. The wood may be from softwood trees such as spruce, pine, fir, larch, douglas fir or hemlock, or from hardwood trees such as birch, aspen, poplar, alder, eucalyptus or acasia, or from a mixture of softwood and hardwood. Nonwood material may be from for example agricultural residues, grasses or other plant substances, such as straw, leaves, bark, seeds, hulls, flowers, vegetables or fruits from cotton, corn, wheat, oat, rye, barley, rice, flax, hemp, manila hemp, sisal hemp, jute, ramie, kenaf, bagasse, bamboo or reed. In one embodiment the pulp is hardwood pulp. In one embodiment the pulp is softwood pulp.

Herein the starting material is called pulp, which may comprise any cellulose-containing fiber material as explained above. In the method, before fibrillation, the provided pulp is pretreated enzymatically with a cellulase at conditions enabling fiber-fiber contacts, which means relatively high consistency of at least 10%. The enzyme is added to the fiber starting material. In one embodiment the subsequent fibrillation is carried out at the same consistency as the enzymatic pretreatment. In one embodiment the subsequent fibrillation is carried out at a lower consistency than the enzymatic pretreatment. In one example the enzymatic treatment is carried out in a first step and the fibrillation is carried out in a second, subsequent, step. In one example the enzymatic pretreatment and subsequent fibrillation are carried out in separate devices and/or containers.

In one embodiment the enzymatically treated fiber material is not diluted before the fibrillation, which may be carried out for example with a disperser or a pin mill. At a high consistency the fibrillated product is in a form of paste or granule. Generally the fibrillated product does not form gel at high concentrations, but to obtain gel the fibrillated cellulose must be dispersed with water. If the fibrillation is carried out at a high consistency, more heat will be generated and a separate heat inactivation of the enzyme may not be necessary.

Consistency is used to describe the dry solid content of wood pulp slurry in water. The consistency of the pulp may be calculated with an equation (oven-dry weight of pulp× 100)/(weight of pulp+water), wherein the oven-drying is carried out at 105° C. In one embodiment the consistency wherein the enzymatic treatment is carried out is in the range of 10-50% by weight, for example 15-40%. In one embodiment said consistency is in the range of 20-35%. It is important to ensure proper mixing at such consistencies, for example by using dynamic mixers, such as rotary drum mixers or compulsory mixers. For example a conventional method wherein the pulp proceeds in a reactor as a plug flow is not suitable.

When an enzymatic pretreatment is used no separate preceding refining step is required. Therefore, in one embodiment the method contains no prerefining step before the enzymatic treatment. In one embodiment the method contains no mechanical pretreatment before the enzymatic treatment. Further, no separate chemical treatment is required. Therefore, in one embodiment the method contains no chemical treatment step before the enzymatic treatment. In one embodiment the method contains no chemical treatment step after the enzymatic treatment. However, even though the chemical treatment after the enzymatic treatment is not necessary, in one embodiment the method contains a chemical treatment step after the enzymatic treatment, before or after the fibrillation step, such as an adsorption of a chemical, for example CMC. The chemical treatment refers to at least any chemical modification of the material. In one embodiment the method contains a moderate mechanical pretreatment step, such as a prerefining step, after the enzymatic treatment, but before the fibrillating step.

However, in another embodiment the method contains a washing step before the enzymatic treatment, for example with mild acid or mild base. In one embodiment the method comprises washing the pulp with acid or base into salt form before the enzymatic treatment. Said washing is not a chemical modification. The pulp may be pretreated with acid and base prior to the enzymatic treatment. In one embodiment the method comprises washing the pulp to obtain pulp in a salt form, for example in Na-form, before the enzymatic treatment.

The pretreatment is effected by subjecting the cellulose pulp to mild acid treatment for removing positively charged ions, followed by treatment with a base containing defined, positively charged ions, for replacing the earlier ions. The pretreatment provides a final product with improved gelling properties and transparency.

In one example the method for pretreating the pulp comprises the steps where an aqueous suspension of native cellulose pulp is brought into contact with an inorganic or organic acid and agitated to obtain pH of the suspension below 4, followed by removal of water and washing the solid matter with water, and forming an aqueous suspension of the solid matter, then at least one water soluble salt of $NH^{4+}$, alkali metal, alkaline earth metal or metal is added to the formed suspension followed by agitation, the pH of suspension is adjusted to more than 7 using an inorganic base, followed by removal of water, and washing the solid matter with distilled or deionized water.

In said pretreating methods the water soluble salt of $NH^{4+}$, alkali metal, alkaline earth metal or metal is suitably used in an amount to obtain a concentration of 0.001 to 0.01 M (0.1 to 1 mol/kg fiber or solid material), particularly of 0.002 to 0.008 M. In said pretreating methods the content of solid matter in the suspension may range from 0.1 to 20% by weight, suitably from 0.5 to 3% by weight.

The inorganic or organic acid is suitably an acid, which can be easily washed away, leaves no undesirable residues in the product and has a pKa-value between −7 and 7.

The organic acid may be selected from short chain carboxylic acids, such as acetic acid, formic acid, butyric acid, propionic acid, oxalic acid and lactic acid. Short chain carboxylic acid refers here to $C_1$-$C_8$ acids. The inorganic acid may suitably be selected from hydrochloric acid, nitric acid, hydrobromic acid and sulphuric acid. The pH may be adjusted using the acid to below 4, suitably to below 3.

Suitably the acid is used as a dilute, from 0.001 to 5 M aqueous solution, which can be conveniently added to the suspension. Suitably the addition time of the acid is between 0.2 to 24 hours.

Water removal from the suspension or slurry may be carried out by any suitable means, for example with web press, pressure filtering, suction filtering, centrifuging and screw press.

The solid matter may be washed 1-5 times, suitably 2-3 times with water after acid treatment to remove excess acid. Washing of solid matter with water may suitably be carried out after the water removal steps using the same equipment.

The water soluble salt of $NH^{4+}$, alkali metal, alkaline earth metal or metal, may be selected from inorganic salts, complexes and salts formed with organic acids, of $NH^{4+}$, alkali metal, alkaline earth metal or metals, suitably of $NH^{4+}$, Na, K, Li, Ag and Cu. The inorganic salt is suitably sulphate, nitrate, carbonate or bicarbonate salt, such as $NaHCO_3$, $KNO_3$ or $AgNO_3$. According to one suitable embodiment the water soluble salt is sodium salt.

The inorganic base may be selected from NaOH, KOH, LiOH and $NH_3$. The pH of the suspension may be adjusted with the inorganic base to more than 7, suitably from 7.5 to 12, particularly suitably from 8 to 9.

After the pH adjustment with the inorganic base, the water removal is carried out and the solid matter is washed with distilled or deionized water. Suitably the washing is repeated or carried out until the conductivity of the used washing liquid, such as filtrate, is less than 200 μS/cm, suitably less than 100 μS/cm, particularly suitably less than 20 μS/cm.

The enzymatic treatment is carried out using a cellulase, which belong to glycoside hydrolases. The "cellulase" as used herein may contain one or more types of cellulase proteins or cellulase activities. In general there are five general groups of cellulases: endocellulases, exocellulases, cellobiases, oxidative cellulase and cellulose depolymerases. Within the above types there are also progressive (also known as processive) and nonprogressive types. Progressive cellulase will continue to interact with a single polysaccharide strand. Nonprogressive cellulase will interact once, then disengage and engage another polysaccharide strand.

Most cellulases show a modular architecture including one or more catalytic modules and one or more modules involved in substrate binding (CBMs, carbohydrate-binding modules) or multienzyme complex formation. These modules are usually connected with a linker peptide with varying length in different cellulases. Generally cellulases may contain three different types of structural arrangements for the glycoside hydrolase active site: a tunnel, which is suitable for processive exo-hydrolysis, a cleft suitable for endo-attack, and a pocket. For example in the Cel6 cellobiohydrolase the two loops covering the active site may occasionally open to allow an endo-type of initial action. The 3D structures of endo-active enzymes from the same family have shown that the same fold can also form a more open, cleft-like active site.

In one embodiment the cellulase comprises exocellulase activity. In one embodiment the cellulase is an exocellulase. Exocellulase activity digests cellulose from the ends of the carbohydrate chain. This provides an effect of loosening the bonds between separate cellulose chains. Without binding to any specific theory it is believed herein that the movement of the enzyme, especially exocellulase, on the cellulose fiber loosens the intercellulosic chain bonds between the chains. On the other hand, the endoglucanases hydrolyze nonprocessively internal bonds of the cellulose chain resulting in a remarkable decrease in the degree of polymerization (DP) of the cellulose even with very small doses of the enzyme. The DP value reflects the structural integrity of the cellulose and a lowered DP value results in lowered strength properties and gel forming ability of the nanofibrillar cellulose. The loosening of the intercellulosic bonds by the exocellulase resulted in increased fiber-fiber interactions in high consistency mixing thus providing enhanced fibrillation of the fibers. The long fibril length will be maintained when mainly or only exocellulase is used. Therefore it is preferred that the endocellulase activity in the enzymatic treatment is minimized or eliminated.

Cellobiohydrolase (CBH) is a cellulase which degrades cellulose by hydrolysing the 1,4-β-D-glycosidic bonds. CBH is an exocellulase (EC 3.2.1.91), which cleaves two to four units from the ends of the exposed chains produced by endocellulase, resulting in the tetrasaccharides or disaccharides, such as cellobiose. Cellobiohydrolase may also be called as exoglucanase. There are two types of CBHs. CBHI cleaves progressively from the reducing end while CBHII cleaves progressively from the nonreducing end of cellulose. In one embodiment the cellulase is a cellobiohydrolase. In one embodiment said cellobiohydrolase is a thermostable cellobiohydrolase. In one embodiment the cellobiohydrolase is cellobiohydrolase I (CBHI), also called as Cel7A. In one embodiment the cellobiohydrolase is cellobiohydrolase II (CBHII), also called as Cel6A.

Fungal cellobiohydrolases were found suitable for the method. In one embodiment said cellobiohydrolase is a fungal cellobiohydrolase, originated for example from mesophilic or thermophilic fungi. Representative examples of such cellobiohydrolases include cellobiohydrolases I and II from *Trichoderma, Aspergillus, Thermoascus, Humicola, Talaromyces, Melanocarpus, Acremonium, Phanerochaete* and *Chaetomium*. Specific examples of fungal celllobiohydrolases include *Trichoderma reesei, Aspergillus niger, Thermoascus aurantiacus, Humicola grisea, Humicola insolens, Talaromyces emersonii, Melanocarpus albomyces, Acremonium thermophilum, Phanerochaete chrysosporium* and *Chaetomium thermophilum* CBHI and CBH II.

In one embodiment said cellobiohydrolase is *Thermoascus aurantiacus* cellobiohydrolase. In one embodiment said cellobiohydrolase is cellobiohydrolase I. In one embodiment said cellobiohydrolase is cellobiohydrolase II.

Endoglucanase is an endocellulase enzyme which randomly hydrolyzes internal glycosidic linkages, such as beta-1,4-glycosidic bonds, at the more amorphous regions of cellulose. Examples of endoglucanases include Cel7B (EGI) and Cel5A (EGII). It is preferred that the cellulase has only exocellulase activity, or it has substantially only exocellulase activity meaning that only traces of other activities, especially other cellulase activities, may be present, for example those which are present in the enzyme preparation as contaminants.

In some cases it may be enough that there is more exocellulase activity than endocellulase activity, but in some cases the endocellulase activity should be minimized. In one embodiment at least 70% of the cellulase activity is exocellulase activity. In one embodiment at least 80% of the cellulase activity is exocellulase activity. In one embodiment at least 90% of the cellulase activity is exocellulase activity. In one embodiment at least 95% of the cellulase activity is exocellulase activity. In one embodiment at least 99% of the cellulase activity is exocellulase activity. Said activity may refer to the specific activity of the enzyme. The cellulase activity refers to total cellulase activity in the enzyme preparation. In another example the activity refers to the amount of protein. In one embodiment at least 70% by weight of the cellulase protein is exocellulase protein. In one embodiment at least 80% of the cellulase protein is exocellulase protein. In one embodiment at least 90% of the cellulase protein is exocellulase protein. In one embodiment at least 95% of the cellulase protein is exocellulase protein. In one embodiment at least 99% of the cellulase protein is exocellulase protein. The cellulase protein refers to total cellulase protein in the enzyme preparation.

In one embodiment the cellulase contains substantially no endoglucanase activity, or the endoglucanase activity is very low, for example less than 20%, less than 10%, less than 5%, or even less than 1% of the cellulase activity. More general in one embodiment the cellulase contains substantially no endocellulase activity, or the endocellulase activity is very low, for example less than 20%, less than 10%, less than 5%, or even less than 1% of the cellulase activity. In one embodiment the cellulase contains substantially no endocellulase protein, or the amount of the endocellulase protein is very low, for example less than 20%, less than 10%, less than 5%, or even less than 1% of the cellulase proteins. In one example a native enzyme preparation is heat-treated prior to use, i.e. before the actual enzymatic treatment, to reduce any endoglucanase activity. In such case it is preferred that the exocellulase activity is more thermostable than any remaining endocellulase activity. The heat treatment may be carried out at 50-90° C. for 5 minutes to 5 hours, for example for 1-2 hours. In one example the heat-treatment is carried out at about 60° C. for about 2 hours. This is generally enough to reduce the endoglucanase activity sufficiently, for example by at least 80%. The temperature and the duration of the heat-treatment are preparation-specific, but they should provide the residual activity describe above for any exocellulase-rich cellulase product, such as CBH-rich cellulase product.

After the enzymatic treatment the enzyme activity may be inactivated and/or the pretreated pulp may be washed before any further mechanical treatment. The inactivation may be carried out by using a heat treatment, for example by heating to 80-90° C. for 10-30 minutes. Another option would be to inactivate the enzyme in the fibrillation treatment wherein the temperature will rise. The pulp may be also diluted, for example by 5-50%. The pulp may be washed to remove enzymes and any contaminating compounds, such as sugars, for example disaccharides, or other compounds which may affect the properties of the final product and the products obtained from the final product, such as a gel. During the wash and/or the dilution the consistency of the pulp may be lowered as more water is introduced. The consistency may be lowered to less than 20%, or less than 10%, for example to a consistency of 1.5-10%, or 1.5-3%, or 3-10%, or 3-5%, or to 5-10%. The lower consistency may enhance the fibrillating efficiency. However, the consistency should not be too low, for example 1% or less, as it results in poor fibrillation, probably because of lack of adequate fiber-fiber collisions, grinding and the like interaction. In one embodiment the consistency of the pulp is not lowered or changed after the enzymatic treatment. In one embodiment the pulp is not diluted after the enzymatic treatment. In one embodiment the pulp is not washed after the enzymatic treatment.

After the enzymatic treatment the pretreated pulp may be fibrillated using any suitable fibrillating method and/or device, for example by using a disperser or a homogenizer, to obtain (nano)fibrillated cellulose. Other examples of such devices include refiner, grinder, colloider, friction grinder, ultrasound sonicator, and fluidizer such as microfluidizer, macrofluidizer or fluidizer-type homogenizer.

In one embodiment there is a mechanical pretreatment step before said fibrillation step, for example prerefining step, which may be carried out for example by using a rotor-rotor dispergator or a homogenizer. In general such a mechanical pretreatment step after the enzymatic treatment is carried out using different equipment than the fibrillation step. Typically said mechanical pretreatment is carried out using machinery capable of processing larger volumes or which will facilitate the processability of the product in the actual fibrillation step. In one example the pretreatment is carried out using a conventional refiner and the fibrillation is carried out using a high pressure homogenizator. In one example the pretreatment is carried out using a conventional refiner and the fibrillation is carried out using a disperser, such as any disperser described herein. In one example the consistency of the pulp is lowered before said pretreatment. In one example the consistency of the pulp is lowered after said pretreatment. In general such a prerefining step is not a fibrillation step, i.e. the pulp is not disintegrated into nanofibrillar cellulose.

In one embodiment the temperature during the treatment is in the range of 30-70° C., such as in the range of 40-55° C. The treatment in said temperature refers to at least the enzymatic treatment. In one example said treatment in said temperature refers both to the enzymatic treatment and the subsequent disintegration/fibrillation treatment. In one example said treatment in said temperature also includes the heat-treatment of the native enzyme preparation.

In one embodiment the fibrillating is carried out by using a disperser having at least one rotor, blade or similar moving mechanical member, such as a rotor-rotor dispergator, which has at least two rotors. In a disperser the fiber material in dispersion is repeatedly impacted by blades or ribs of rotors striking it from opposite directions when the blades rotate at the rotating speed and at the peripheral speed determined by the radius (distance to the rotation axis) in opposite directions. Because the fiber material is transferred outwards in the radial direction, it crashes onto the wide surfaces of the blades, i.e. ribs, coming one after each other at a high peripheral speed from opposite directions; in other words, it receives several successive impacts from opposite directions. Also, at the edges of the wide surfaces of the blades, i.e. ribs, which edges form a blade gap with the opposite edge of the next rotor blade, shear forces occur, which contribute to the disintegration of the fibers and detachment of fibrils. The impact frequency is determined by the rotation speed of the rotors, the number of the rotors, the number of blades in each rotor, and the flow rate of the dispersion through the device.

In a rotor-rotor dispergator the fiber material is introduced through counter-rotating rotors, outwards in the radial direction with respect to the axis of rotation of the rotors in such a way that the material is repeatedly subjected to shear and impact forces by the effect of the different counter-rotating rotors, whereby it is simultaneously fibrillated.

In one example the fiber material is supplied through a plurality of counter-rotating rotors (R1, R2, R3 . . . ) outwards in the radial direction with respect to the rotation axis (RA) of the rotors in such a way that the material is repeatedly subjected to shear and impact forces by the effect of the blades of the different counter-rotating rotors, whereby it is simultaneously fibrillated, wherein the fibrillation is effected by means of impact energy utilizing a series of frequently repeated impacts having varying directions of action caused by several successive impacts from opposite directions. There may be at least two counter-rotating rotors, such as three, four, five, six or more. WO 2013/072559 discloses such a device in detail.

As a matter of great importance, the fiber material in suspension is repeatedly impacted by the blades or ribs of the rotors striking it from opposite directions when the blades rotate at the rotating speed and at the peripheral speed determined by the radius (distance to the rotation axis) in opposite directions. Because the fiber material is transferred outwards in the radial direction, it crashes onto the wide surfaces of the blades, i.e. ribs, coming one after the other at a high peripheral speed from opposite directions; in other words, it receives several successive impacts from opposite directions. Also, at the edges of the wide surfaces of the blades, i.e. ribs, which edges form a blade gap with the opposite edge of the next rotor blade, shear forces occur, which contribute to the fibrillation.

On the periphery of each rotor, there are several blades which, together with several blades of the preceding and/or next rotor in the radial direction, because of their rotary movement in opposite directions, repeatedly produce several narrow blade spaces or gaps, in which the fibers are also subjected to shear forces as the opposite edges of the blades, i.e. ribs, pass each other at a high speed when moving into opposite directions. By the arrangement of the series of rotors with alternating rotating directions and the distribution of the blades on peripheries of the rotors, impacts coming at a high frequency from different directions can be achieved.

It can be stated that in each pair of counter-rotating rotors, a large number of narrow blade gaps and, correspondingly, reversals of impact directions, are generated during a single rotation of each rotor, the recurrence frequency being proportional to the number of blades i.e. ribs on the periphery. Consequently, the direction of impacts caused by the blades i.e. ribs on the fiber material is changed at a high frequency. The number of blade gaps during the rotations and their recurrence frequency depend on the density of the blades distributed onto the periphery of each rotor, and correspondingly on the rotation speed of each rotor. The number of such rotor pairs is n−1, where n is the total number of rotors, because one rotor always forms a pair with the next outer rotor in the radial direction, except for the outermost rotor, through which the processed pulp exits the refining process.

Different rotors may have different numbers of blades i.e. ribs, for example in such a way that the number of blades increases in the outermost rotors. The number of blades i.e. ribs can also vary according to another formula.

The density of the blades/ribs on the periphery of each rotor, as well as the angles of the blades to the radial direction, as well as the rotation speeds of the rotors can be used to affect the refining efficiency (the refining intensity) as well as the throughput time of the fiber material to be refined.

The disperser described above may be used for refining fiber material at higher consistencies compared with e.g. a homogenizer, because gelling during refining of the same material several times does not require diluting of the material. The density of the blades/ribs can be adjusted to correspond to the consistency used at the time.

The supplying can be implemented so that the mixture to be passed through the rotors contains a given volume part of a gaseous medium mixed in it, but as a separate phase, for example greater than 10 vol. %. For intensifying the separation of the fibrils, the content of gas is at least 50 vol. %, advantageously at least 70% and more advantageously in the range of 80-99 vol. %; that is, expressed in degrees of filling (the proportion of the fiber suspension to be processed in the volume passing through the rotor) lower than 90 vol. %, not higher than 50 vol. %, not higher than 30 vol. % and correspondingly in the range of 1-20 vol. %. The gas is advantageously air, wherein the fiber suspension to be processed can be supplied in such a way that a given proportion of air is admixed to the fiber suspension. The air, whether at room temperature (20-25° C.) or at elevated temperature, will raise the dry matter content of the fiber material during the disintegration treatment. The gaseous medium is not included in the calculation of the consistency, which is based on the proportion of the fibers in the pulp, that is, mixture of fibers and liquid.

The method can be easily upscaled, for example by increasing the number of rotors. One example of a suitable dispersing device is an Atrex mixer, for example model G30.

Figure 3:
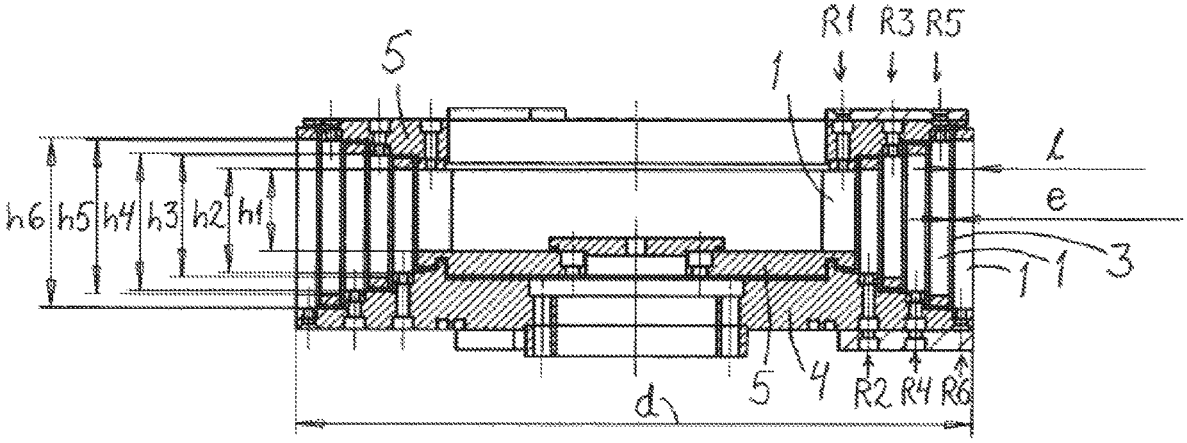
FIG. 3 shows a device used as an example in a sectional plane A-A coinciding with the axis of rotation of the rotors.

In one example a device shown in FIG. 3 is used in the disintegration treatment where the fiber material at high consistency is subjected to repeated impacts at high frequency. The device comprises several counter-rotating rotors R1, R2, R3 . . . placed concentrically within each other so that they rotate around a common rotation axis RA. The device comprises a series of rotors R1, R3 . . . rotating in the same direction, and rotors R2, R4 . . . rotating in the opposite direction, wherein the rotors are arranged pairwise so that one rotor is always followed and/or preceded in the radial direction by a counter-rotating rotor. The rotors R1, R3 . . . rotating in the same direction are connected to the same mechanical rotating means 5. The rotors R2, R4 . . . rotating in the opposite direction are also connected to the same mechanical rotating means 4 but rotating in a direction opposite to the direction of the aforementioned means. Both rotating means 4, 5 are connected to their own drive shaft which is introduced from below. The drive shafts can be located concentrically with respect to the rotation axis RA, for example in such a way that the outer drive shaft is connected to a lower rotating means 4, and the inner drive shaft placed inside it and rotating freely with respect to it, is connected to an upper rotating means 5.

The figure does not show the fixed housing for the device, inside which the rotors are placed to rotate. The housing comprises an inlet, through which material can be supplied from above to the inside of the innermost rotor R1, and an outlet located by the side, oriented approximately tangentially outwards with respect to the peripheries of the rotors. The housing also comprises through-holes for the drive shafts down below.

Figure 4:
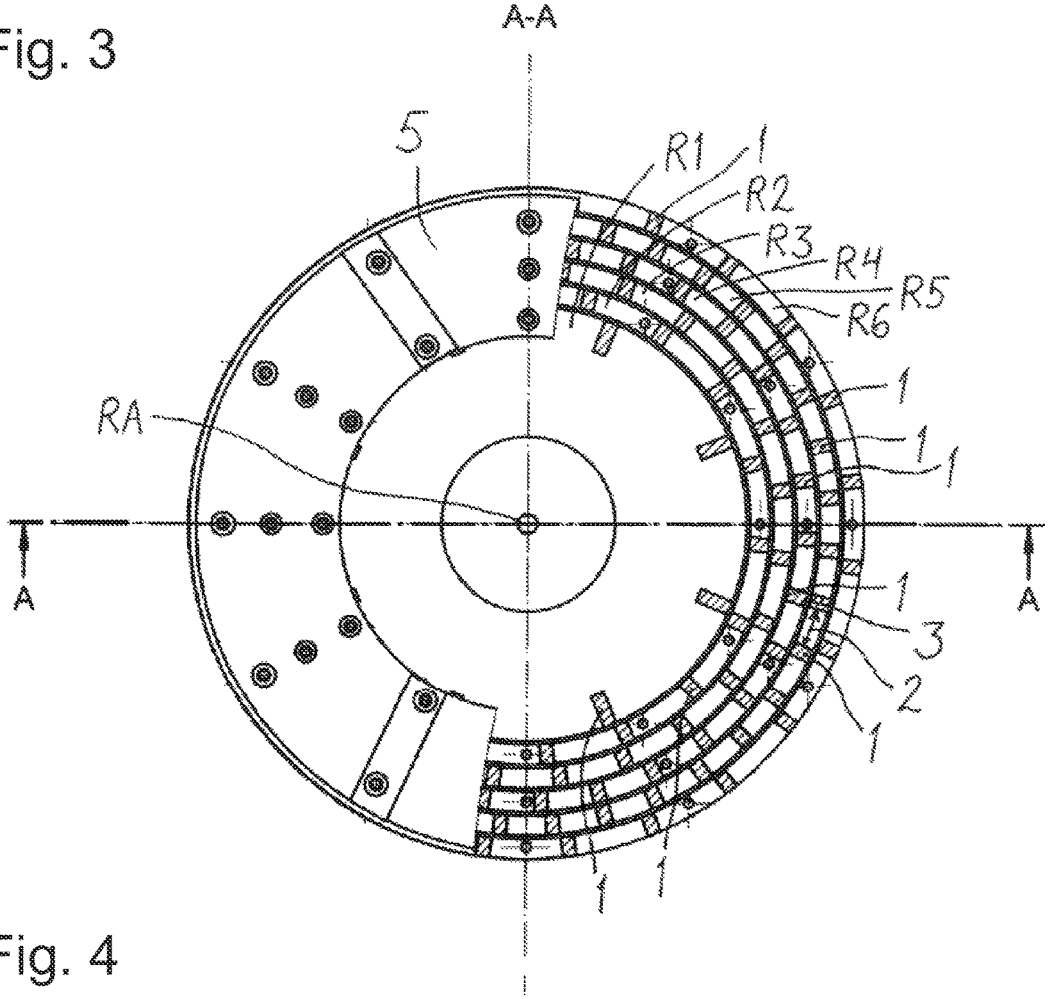
FIG. 4 shows the device of FIG. 3 in a partial horizontal section.

In practice, the rotors consist of vanes or blades 1 placed at given intervals on the periphery of a circle whose geometric center is the rotation axis RA, and extending radially. In the same rotor, flow-through passages 2 are formed between the vanes 1, through which passages the material to be refined can flow radially outwards. Between two successive rotors R1, R2; R2, R3; R3, R4; etc., several blade spaces or gaps are formed repeatedly and at a high frequency during the rotary movement of the rotors in the opposite direction. In FIG. 4, reference numeral 3 denotes such blade gaps between the blades 1 of the fourth and fifth rotors R4, R5 in the radial direction. The blades 1 of the same rotor form narrow gaps, i.e. blade gaps 3, with the blades 1 of the preceding rotor (having the narrower radius on the periphery of the circle) in the radial direction and with the blades 1 of the next rotor (placed on the periphery of the circle with the greater radius) in the radial direction. In a corresponding manner, a large number of changes in the impact direction are formed between two successive rotors when the blades of the first rotor rotate in a first direction along the periphery of the circle, and the blades of the next rotor rotate in the opposite direction along the periphery of a concentric circle.

The first series of rotors R1, R3, R5 is mounted on the same mechanical rotating means 5 that consists of a horizontal lower disc and a horizontal upper disc, connected to each other by the blades 1 of the first rotor R1, innermost in the radial direction. On the upper disc, in turn, are mounted the blades 1 of the other rotors R3, R4 of this first series, with the blades 1 extending downwards. In this series, the blades 1 of the same rotor, except for the innermost rotor R1, are further connected at their lower end by a connecting ring. The second series of rotors R2, R4, R6 is mounted on the second mechanical rotating means 4 which is a horizontal disc placed underneath said lower disc, and to which the blades 1 of the rotors of the series are connected, to extend upwards. In this series, the blades 1 of the same rotor are connected at their upper end by a connecting ring. Said connecting rings are concentric with the rotation axis RA. The lower discs are further arranged concentrically by an annular groove and a matching annular protrusion on the facing surfaces of the discs, also placed concentrically with the rotation axis RA and being equally spaced from it.

FIG. 3 shows that the vanes or blades 1 are elongated pieces parallel to the rotation axis R1 and having a height greater than the width I (the dimension in the radial direction). In the horizontal section, the blades are quadrangular, in FIG. 4 rectangular. The fiber material is passed crosswise to the longitudinal direction of the blades, from the center outwards, and the edges at the sides of the surfaces facing the radial direction in the blades 1 form long and narrow blade gaps 3 extending in the longitudinal direction of the blade, with the corresponding edges of the blades 1 of the second rotor.

The rotors R1, R2, R3 . . . are thus, in a way, through-flow rotors in the shape of concentric bodies of revolution with respect to the rotation axis, wherein their part that processes the fiber material consists of elongated vanes or blades 1 extending in the direction of the rotation axis RA, and of flow-through passages 2 left there between.

FIG. 3 also shows that the heights h1, h2, h3 . . . of the rotor blades 1 increase gradually from the first, i.e. the innermost rotor R1 outwards. As a result, the heights of the flow-through passages 2 limited by the rotor blades 1 also increase in the same direction. In practice, this means that when the cross-sectional area of the radial flow increases outwards as the peripheral length of the rotors increases, the increase in the height also increases this cross-sectional area. Consequently, the travel speed of a single fiber is decelerated in outward direction, if the volume flow is considered to be constant.

By the centrifugal force caused by the rotational movement of the rotors, the material to be processed is passed through the rotors with a given retention time.

As can be easily concluded from FIG. 4, during a single whole rotation of a pair of rotors (from a position in which given blades 1 are aligned, to the position in which the same blades 1 are aligned again), several blade gaps 3 are formed when successive blades 1 in the peripheral direction encounter successive blades 1 of the second rotor. As a result, the material transferred through the passages 2 outward in the radial direction is continuously subjected to shear and impact forces in the blade gaps 3 between different rotors and in the flow-through passages 2 between the blades 1 on the periphery of the rotor, when the material is passed from the range of the rotor to the range of an outer rotor, while the movement of the blades in peripheral direction and the directional changes of the movement caused by the rotors rotating in different directions prevent the through-flow of the material too fast out through the rotors by the effect of the centrifugal force.

The blade gaps 3 and, correspondingly, the encounters of blades 1 and the respective changes in the impact directions in two rotors successive in the radial direction are generated at a frequency of [1/s] which is $2 \times fr \times n1 \times n2$, where n1 is the number of blades 1 on the periphery of the first rotor, n2 is the number of blades on the periphery of the second rotor, and fr is the rotational speed in revolutions per second. The coefficient 2 is due to the fact that the rotors rotate at the same rotational speed in opposite directions. More generally, the formula has the form $(fr(1)+fr(2)) \times n1 \times n2$, where fr(1) is the rotational speed of the first rotor and fr(2) is the rotational speed of the second rotor in the opposite direction.

Furthermore, FIG. 4 shows how the number of blades 1 may be different in different rotors. In the figure, the number of blades 1 per rotor increases starting from the innermost rotor, except for the last rotor R6 where it is smaller than in the preceding rotor R5. As the rotational speeds (rpm) are equal irrespective of the location and direction of rotation of the rotor, this means that the frequency at which the blades 3 pass a given point and, correspondingly, the frequency of formation of the blade gaps 3 increases from the inside outwards in the radial direction of the device.

In FIG. 3, the dimension I of the blades in the direction of the radius r is 15 mm, and the dimension e of the blade gap 3 in the same direction is 1.5 mm. Said values may vary, for example from 10 to 20 mm and from 1.0 to 2.0 mm, respectively. The dimensions are influenced by, for example, the consistency of the fiber material to be treated.

The diameter d of the device, calculated from the outer rim of the outermost rotor R6, can vary according to the capacity desired. In FIG. 3, the diameter is 500 mm, but the diameter can also be greater, for example greater than 800 mm. When the diameter is increased, the production capacity increases in a greater proportion than the ratio of the diameters.

It has been found that a decrease in the rotation speed of the rotors impairs fibrillation. Similarly, a decrease in the flow rate (production) clearly improves fibrillation; in other words, the greater the retention time of the material to be processed during which it is subjected to the impact and shear forces of the blades i.e. ribs, the better the fibrillation result.

Another example of a device suitable for fibrillating is a pin mill, such as a multi-peripheral pin mill. One example of such device, as described in U.S. Pat. No. 6,202,946 B1, includes a housing and in it a first rotor equipped with collision surfaces; a second rotor concentric with the first rotor and equipped with collision surfaces, the second rotor being arranged to rotate in a direction opposite to the first rotor; or a stator concentric with the first rotor and equipped with collision surfaces. The device includes a feed orifice in the housing and opening to the center of the rotors or the rotor and stator, and a discharge orifice on the housing wall and opening to the periphery of the outermost rotor or stator.

In one embodiment the fibrillating is carried out by using a homogenizer. In a homogenizer the fiber material is subjected to homogenization by an effect of pressure. The homogenization of the fiber material dispersion to nanofibrillar cellulose is caused by forced through-flow of the dispersion, which disintegrates the material to fibrils. The fiber material dispersion is passed at a given pressure through a narrow through-flow gap where an increase in the linear velocity of the dispersion cause shearing and impact forces on the dispersion, resulting in the removal of fibrils from the fiber material. The fiber fragments are disintegrated into fibrils in the fibrillating step.

The fiber material wherein the structure of the cellulose has been weakened or "labelized" enzymatically can already be influenced well in the disperser by impacts which come from blades in opposite directions and which can be produced by a series of successive rotors, and by shear forces generated at the edges of the blades when the fibers are transferred from the range of action of one rotor to the range of action of the next rotor. The formation of an aqueous dispersion of nanofibrillar cellulose can be completed in the successive processing in the homogenizer, which yields a uniform aqueous gel-like dispersion of cellulose fibrils, which can be characterized by high viscosity values at low shear stress values and which can be seen by visual analysis as a clear gel without turbidity caused by fiber fragments. Therefore in one embodiment the fibrillation is carried out by first using a disperser and subsequently by using a homogenizer.

In one embodiment said pulp is non-modified pulp, i.e. the fiber material that is subjected to the enzymatic treatment is non-modified, i.e. the initial internal strength of the cellulose is preserved, which facilitates the fibrillation in the present method. Such modifications would be conventionally chemical wherein for example functional groups have been introduced in the cellulose chain, for example carboxymethylated, oxidized (e.g. N-oxyl mediated oxidizations, such as by the "TEMPO" chemical) or cationized cellulose. Therefore the non-modified pulp refers to pulp that is not chemically pretreated to chemically modify the pulp, i.e. chemically non-modified pulp. In one example the pulp or the fibrillated pulp is chemically modified after the enzymatic treatment, i.e. the end product contains such chemical modifications as described herein.

One example of such modification method is oxidation of cellulose. In the oxidation of cellulose, the primary hydroxyl groups of cellulose are oxidized catalytically by a heterocyclic nitroxyl compound, for example 2,2,6,6-tetramethylpiperidinyl-1-oxy free radical, "TEMPO". These hydroxyl groups are oxidized to aldehydes and carboxyl groups. Thus, part of the hydroxyl groups that are subjected to oxidation can exist as aldehyde groups in the oxidized cellulose, or the oxidation to carboxyl groups can be complete.

Fiber material modified by catalytic oxidation may have a carboxylate content of at least or above 0.8 mmol/g, preferably at least or above 0.95 mmol/g, and most preferably at least or above 1.00 mmol/g, based on weight dried pulp. The carboxylate content is preferably in the range of 0.8-1.8, more preferably 0.95-1.65 and most preferably 1.00-1.55 mmol/g. In fiber material where the cellulose is carboxymethylated, the degree of substitution is above 0.1, preferably at least or above 0.12. The degree of substitution is preferably in the range of 0.12-0.2 in the carboxymethylated cellulose. In fiber material where the cellulose is cationized, the degree of substitution is at least or above 0.1, preferably at least or above 0.15. The degree of substitution is preferably in the range of 0.1-0.6, more preferably 0.15-0.35 in the cationized cellulose.

Cellulose may be modified physically by adsorbing anionic or cationic substances on cellulose surface contains the adsorbed substances in sufficiently high amounts, 20-1000 mg/g, preferably 40-500 mg/g and most preferably 90-250 mg/g, based on weight of dried pulp. The substances added are preferably water-soluble. For example sodium carboxymethyl cellulose (CMC) is a substance that can be added to make anionically charged physically modified cellulose.

The anionic or cationic substances may be adsorbed in an amount corresponding to the preferable amounts of cationization or anionization (chemical modification) which can be expressed as molar equivalents (eq/g or meq/g), that is, in an amount representing the same amount of ionic charge as obtained by chemical modification per 1 g pulp.

Furthermore, the separation of fibrils works well in in the disperser when the pH of the fiber material dispersion is in the neutral or slightly alkaline range (pH in the range of 6-9, advantageously in the range of 7-8). An elevated temperature (higher than 30° C.) also contributes to the fibrillation. With respect to the temperature, the normal operating environment for processing is usually in the range of 20-70° C. The temperature is advantageously in the range of 35-55° C. If a thermostable enzyme is used for the enzymatic treatment, the temperature may be higher already at an earlier stage of the treatment. For example, the whole treatment comprising the enzymatic treatment and the fibrillating treatment may be carried out at the same elevated temperature, which saves time and/or energy as there is no need to adjust the temperature of the process.

In the homogenizer, the homogenization pressure applied may be in the range of 200-1000 bar, advantageously in the range of 300-650 bar.

In the homogenizer the pH values can be the same as in the disperser. The temperature is not allowed to rise above 90° C.

In one embodiment the fibrillation is carried out at a lowered consistency. As the final result, the nanofibrillar cellulose suspension obtained after the fibrillation is a gel with strong shear thinning properties. Typically, its viscosity may be measured for example by a Brookfield viscometer. Complete fibrillation of the fibers takes place as a function of energy consumption, and the proportion of non-disintegrated pieces of fiber wall contained in nanofibrillar cellulose may be measured for example by a Fiberlab analyzer equipment.

In one embodiment the fibrillation is carried out at the consistency of the enzymatic treatment, i.e. the consistency is not lowered before the fibrillation step. In such case the nanofibrillar cellulose obtained after the fibrillation is more concentrated and it may be in a form of gel pieces, powder, paste or granules. The consistency may be in the range of 10-50%, such as in the range of 15-40%, or in the range of 20-35%.

Typically in the method the aim is to obtain, as the final product, nanofibrillar cellulose whose Brookfield viscosity, measured at a consistency of 1.5% by weight, 10 rpm, is at least 1000 mPa·s, advantageously at least 5000 mPa·s. In addition to the high viscosity, the aqueous nanofibrillar cellulose dispersions obtained are also characterized by so-called shear thinning; that is, the viscosity decreases as the shear rate increases. The Brookfield viscosities measured in the Examples were in the range of about 8500-10000 mPa·s, measured at a consistency of 1.5% by weight, 10 rpm.

Furthermore, the aim is obtain shear thinning nanofibrillar cellulose having a zero shear viscosity ("plateau" of constant viscosity at small shearing stresses) in the range of 500-20000 Pa·s, advantageously 1000-8000 Pa·s and a yield stress (shear stress where the shear thinning begins) in the range of 0.5 to 20 Pa, advantageously in the range of 1-5 Pa, measured at a consistency of 0.5% by weight in aqueous medium.

In the definitions above, the consistencies refer to consistencies, at which the measurements are taken, and they are not necessarily consistencies of the product obtained by the method.

In one embodiment the fibrillation treatment is continued until the nanofibrillar cellulose, which may be withdrawn from the fibrillation treatment, has achieved a zero shear viscosity of 500 to 20000 Pa·s, such as 800 to 5000 Pa·s, even 1000 to 3000 Pa·s, and a yield stress of 0.5 to 20 Pa, preferably in the range of 1-5 Pa, when measured at a consistency of 0.5% by weight.

In one embodiment the fibrillation treatment is continued until the nanofibrillar cellulose, which may be withdrawn from the fibrillation treatment, has more than 90% by weight of the fibers in the fiber fraction of 0-0.2 mm (measured using FS5 fiber analysis).

One embodiment provides a nanofibrillar cellulose product, which, when dispersed to a concentration of 0.5% in water, has a zero shear viscosity in the range of 500-20000 Pa·s, such as 800 to 5000 Pa·s, even 1000 to 3000 Pa·s, and a yield stress in the range of 0.5-20 Pa, preferably in the range of 1-5 Pa, and more than 90% by weight of the fibers are in the fiber fraction of 0-0.2 mm (measured using FS5 fiber analysis). Preferably said nanofibrillar cellulose product is obtained with the method described herein. In one embodiment the nanofibrillar cellulose product is native nanofibrillar cellulose product.

The enzymatic production method can be detected from the final product by detecting the enzymes present in the product. Even though the enzymes were inactivated during the process, the enzyme proteins remain in the nanofibrillar cellulose product and they may be characterized using methods known in the art, such as by isolating and/or characterizing the enzyme proteins, for example by using antibodies to detect the different proteins, by using chromatography or electrophoresis, or by sequencing the proteins. Therefore the used proteins and the proportions thereof may be detected from the product and thereby the preparation method of the product may be determined. Further, the use of exocellulases rather than endocellulases in the enzymatic pretreatment can be detected from the structure and properties of the obtained nanofibrillar cellulose, for example from the high degree of polymerization, strength properties and/or gel forming ability of the nanofibrillar cellulose.

The obtained material may be in the form of soft granules, non-sticky paste, sticky paste, or partially flowing paste depending on the enzyme dosage, treatment time and consistency. One embodiment provides said native nanofibrillar cellulose product in a form of paste. One embodiment provides said native nanofibrillar cellulose product in a form of a granule. Such a paste or granule, when dispersed, to a concentration of 0.5% in water, has a zero shear viscosity in the range of 500-20000 Pa·s, such as 800 to 5000 Pa·s, even 1000 to 3000 Pa·s, and a yield stress in the range of 0.5-20 Pa, preferably in the range of 1-5 Pa, and more than 90% by weight of the fibers are in the fiber fraction of 0-0.2 mm (measured using FS5 fiber analysis).

A granule as used herein refers to a nanofibrillar cellulose product, which comprises moist powder containing aggregate particles formed of cellulose nanofibrils. These are formed due to high solid fibrillation. A median particle diameter of such a granule, determined by laser diffraction analysis, may be in the range of 100-1000 micrometers, for example in the range of 150-500 micrometers.

Particle size of such moist cellulose powder may be measured for example by Beckman Coulter LS320 (laser-diffraction particle size analyzer) with the following procedure. 4 g of powder is dispersed to 500 ml of water with hand mixer. Particles are fed into particle analyzer until there are enough particles in a circulation. Water is used as a background liquid. Coulter LS Particle size Median diameter is measured.

EXAMPLES

Heat treatment (2 hours at 60° C.) was carried out to reduce detrimental endoglucanase activity of the native preparation. The enzymatic treatments of pulp were carried out in tempered mixer (Lödige process technology, Germany) with modified *Thermoascus aurantiacus* CBHI/Cel7A enzyme (Roal OY) for 3 hours at 50° C., pH 5-6, 100 rpm, pulp consistency 30%.

The degree of cell wall unravel can be adjusted by the enzyme dosage and duration of the treatment. After enzyme inactivation by heating to 85° C. for 15 minutes, dilution and washing steps the pulp was fibrillated with Atrex mixer.

Two separate enzyme-treated bleached birch pulp batches were prepared. Samples from both batches were fibrillated in Atrex disperser, 4 passes (Example 1 and Example 2). Untreated bleached birch kraft pulp was fibrillated as a reference sample. The fiber size distribution and viscosity of the gels were determined.

FIG. 1 illustrates the fiber size measured by Metso FS5. 1 g of fibrillated cellulose was diluted in two steps to obtain a trial sample: 1.60 mg fibers in 50 ml water. The sample was fed to fiber analyzer. The sample fiber length clearly decreases by the enzyme treatment (Example 2) compared to the reference.

The enzyme-treated and Atrex-fibrillated samples formed a gel. The viscosity of the gel was measured by a Brookfield viscometer. The viscosities measured at a consistency of 1.5%, 10 rpm were 9950 mPa·s, Example 1 and 8550 mPa·s, Example 2.

To verify the success of fibrillation, rheological measurements of the Example 2 in the form of nanofibrillar cellulose hydrogels were carried out with a stress controlled rotational rheometer (ARG2, TA instruments, UK) equipped with four-bladed vane geometry. Samples were diluted with deionized water (200 g) to a concentration of 0.5 w % and mixed with Waring Blender (LB20E*, 0.5 l) 3×10 sec (20 000 rpm) with short break between the mixing. Rheometer measurement was carried out for the sample. The diameters of the cylindrical sample cup and the vane were 30 mm and 28 mm, respectively, and the length was 42 mm. The steady state viscosity of the hydrogels is measured using a gradually increasing shear stress of 0.001-1000 Pa. After loading the samples to the rheometer they are allowed to rest for 5 min before the measurement is started. The steady state viscosity is measured with a gradually increasing shear stress (proportional to applied torque) and the shear rate (proportional to angular velocity) is measured. The reported viscosity (=shear stress/shear rate) at a certain shear stress is recorded after reaching a constant shear rate or after a maximum time of 2 min. The measurement is stopped when a shear rate of 1000 $s^{-1}$ is exceeded. The method is used for determining zero-shear viscosity.

Figure 2:
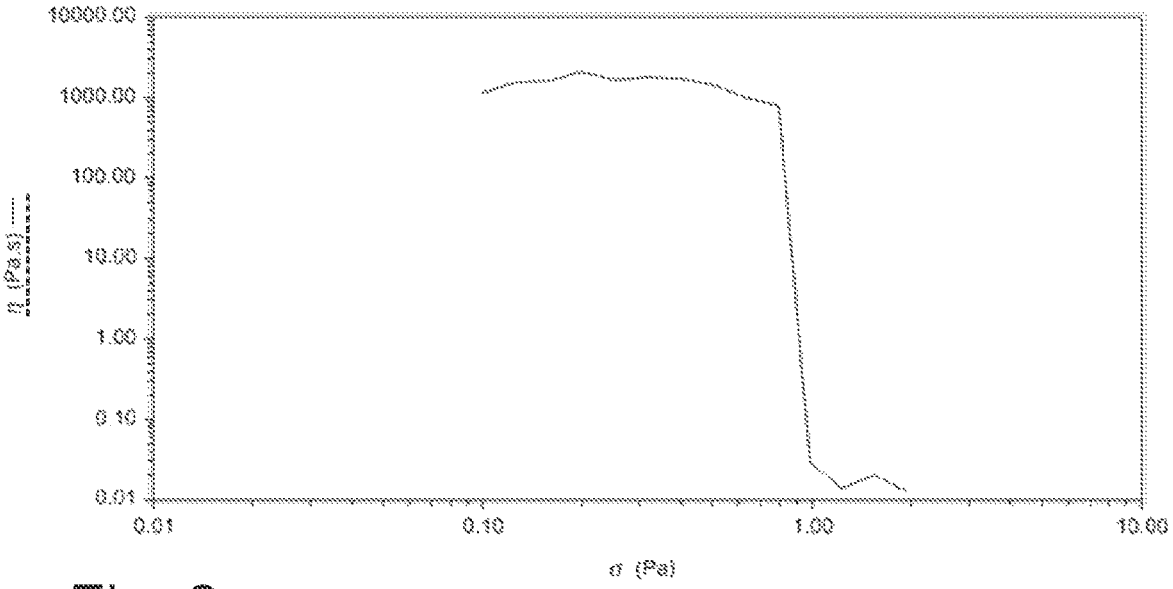
FIG. 2 shows a graph illustrating viscosity as a function of shear stress for a nanofibrillar cellulose product sample in 0.5% dilution.

The viscosity as a function of shear stress for the four nanofibrillar cellulose product samples in 0.5% dilution is presented in FIG. 2.

The invention claimed is:

1. A method for producing nanofibrillar cellulose, the method comprising providing pulp, treating said pulp enzymatically to open and/or unravel fiber cell wall and to loosen bonds between separate cellulose chains in a first step at a consistency of 10 to 50% by weight with a cellulase in mixing, wherein at least 70% of the cellulase activity is exocellulase activity, and after the enzymatic treatment fibrillating said treated pulp in a second, subsequent step, at a consistency of 5 to 50% by weight to obtain nanofibrillar cellulose, wherein the nanofibrillar cellulose has a diameter of less than 200 nanometers.

2. The method of claim 1, wherein at least 80% of the cellulase activity is exocellulase activity.

3. The method of claim 1, wherein the cellulase is an exocellulase.

4. The method of claim 3, wherein the cellulase is a cellobiohydrolase.

5. The method of claim 1, wherein less than 20% of the cellulase activity is endocellulase activity.

6. The method of claim 1, wherein the cellulase contains substantially no endocellulase activity.

7. The method of claim 1, wherein the method contains no prerefining step before the enzymatic treatment.

8. The method of claim 1, wherein the temperature during the treatment is in the range of 30-70° C.

9. The method of claim 1, wherein the pulp has not been chemically treated prior to treating the pulp enzymatically.

10. The method of claim 1, comprising washing the pulp with acid or base into salt form before the enzymatic treatment.

11. The method of claim 1, wherein the fibrillating is carried out by using a disperser.

12. The method of claim 1, wherein the fibrillating is carried out by using a homogenizer or an equipment selected from a refiner, a grinder, a colloider, a friction grinder, a pin mill, an ultrasound sonicator, or a fluidizer.

13. The method of claim 1, comprising a mechanical pretreatment step, after the enzymatic treatment but before the fibrillating step.

14. The method of claim 1, wherein the fibrillation is carried out at the same consistency as the enzymatic treatment.

15. The method of claim 1, wherein the fibrillation is carried out at a lower consistency than the enzymatic treatment.

16. The method of claim 1, wherein the fibrillation treatment is continued until the nanofibrillar cellulose has achieved a zero shear viscosity in the range of 500-20000 Pas and a yield stress in the range of 0.5-20 Pa when measured at a consistency of 0.5% by weight.

17. The method of claim 1, wherein the fibrillation treatment is continued until the nanofibrillar cellulose has more than 90% by weight of the fibers in the fiber fraction of 0-0.2 mm.

18. The method of claim 1, wherein the pulp is wood pulp.

19. The method of claim 1, wherein at least 90% of the cellulase activity is exocellulase activity.

20. The method of claim 1, wherein less than 10% of the cellulase activity is endocellulase activity.

21. The method of claim 1, wherein the enzymatic treatment is carried out at a consistency in the range of 15-40%.

22. The method of claim 1, further comprising lowering the consistency before the fibrillating step to 1.5 to 10%.

23. The method of claim 1, wherein the mixing is carried out by using a dynamic mixer.

24. The method of claim 1, wherein the nanofibrillar cellulose has a median length in the range of 1 to 50 μm.

25. The method of claim 1, wherein the method includes no chemical modification step before or after the enzymatic treatment.

26. The method of claim 1, wherein the pulp is non-modified pulp or bleached pulp which is not otherwise modified.

27. The method of claim 1, wherein the fibrillation treatment is continued until the nanofibrillar cellulose achieves a zero shear viscosity in the range of 1000-8000 Pas and a yield stress in the range of 1-5 Pa when measured at a consistency of 0.5% by weight.

* * * * *